US005425461A

United States Patent [19]

Larson

[11] Patent Number: 5,425,461

[45] Date of Patent: Jun. 20, 1995

[54] DISPLAY DEVICE

[75] Inventor: Douglas B. Larson, Cannon Falls, Minn.

[73] Assignee: IMI Cornelius Inc., Anoka, Minn.

[21] Appl. No.: 297,668

[22] Filed: Aug. 29, 1994

Related U.S. Application Data

[60] Division of Ser. No. 282,099, Jul. 28, 1994, which is a continuation of Ser. No. 171,499, Dec. 22, 1993, abandoned.

[51] Int. Cl.[6] ..... A47F 5/00

[52] U.S. Cl. ..... 211/88; 211/59.1

[58] Field of Search ..... 248/221.1, 220.3, 231.3, 248/220.4; 211/59.1, 88, 71, 181

[56] References Cited

U.S. PATENT DOCUMENTS

| | | | |
|---|---|---|---|
| 4,029,282 | 6/1977 | Dauth | 248/221.1 |
| 4,606,466 | 8/1986 | Fredrickson | 211/59.1 |
| 4,610,413 | 9/1986 | Pedersen | 248/220.3 |
| 4,634,010 | 1/1987 | Otema | 211/96 |
| 4,775,054 | 10/1988 | Dixon | 211/57.1 |
| 4,961,504 | 10/1990 | Larson | 211/59.1 |
| 5,042,669 | 8/1991 | Goldring | 211/57.1 |
| 5,305,898 | 4/1994 | Merl | 211/87 |

*Primary Examiner*—Alvin C. Chin-Shue
*Assistant Examiner*—Sarah L. Purol
*Attorney, Agent, or Firm*—Sten Erik Hakanson

[57] ABSTRACT

A peg bar display device includes an elongate rectangular channel for retaining a plurality of display pegs therein. An interior area of the rectangular channel receives an elongate stop that rests on the pegs within the channel interior area for preventing rotation thereof. A straddle support is also shown having a central upper rod and a pair of lower rods below and extending on either side of the central rod parallel thereto. The straddle support provides for supporting products thereon wherein fight and left symmetrical portions of the product straddle the upper rod on either side thereof and where bottom ends of the right and left portions rest on the lower rods.

7 Claims, 5 Drawing Sheets

DISPLAY DEVICE

The present application is a divisional of application Ser. No. 08/282,099 filed Jul. 28, 1994, which was a continuation of Ser. No. 08/171,499 filed Dec. 22, 1993, now abandoned.

BACKGROUND OF THE INVENTION

1. Field of the Invention

The present invention relates to display devices, and in particular peg bar type display devices.

2. Background Various types of peg bar display devices are known in the art, as seen for example in U.S. Pat. Nos. 4,610,41, 4,961,504, and 5,114,021, the contents of which are incorporated herein by reference thereto. As is taught therein a horizontally supported rectangular channel rod includes a plurality holes for releasably receiving elongate pegs therein. The pegs provide for a relatively inexpensive means for suspending therefrom of a plurality of retail goods.

A problem has been found with such pegs wherein, though they are prevented from being pulled directly out from the supporting channel rod, they can rotate therein. Such rotation typically presents no problem if there exists only the singular peg. However if the peg has an attachment that extends therefrom, such as a price label support, there will be an increased tendency for the peg to rotate due to incidental contact with the extending attachment. Thus, in the case of a peg having price label support, the label may not be presented to the customer in the desired horizontal orientation wherein it is easily read and aesthetically pleasing.

Accordingly, it would be desirable to have a peg bar display wherein the pegs can be prevented from rotating as well as prevented from being pulled out from their supports.

A further problem with such pegs concerns their limitations with respect to their ability to display certain types of products. Individual display pegs generally contemplate the suspending therefrom of the goods being sold. Typically, the product will have a centrally located tab on the exterior top surface of the packaging thereof, the tab having a hole through which the peg extends. Thus, there will oftentimes be some space lost due to the height of the tab. This situation can be a concern where multiple parallel horizontal rows of the product are contemplated, but where the space allocated to the product is particularly limited. Also, suspended products can easily move or swing beneath the peg bar, which movement may be unwanted due to a physical aspect of the product itself or for product presentation concerns. In addition, certain products, due to their size or weight do not lend themselves well to suspending from an individual peg.

Accordingly, it would be desirable to have a display device for certain types of products where the amount of product displayed over a given vertical surface area is maximized and where such products are firmly held in place.

SUMMARY OF THE INVENTION

A locking mechanism for preventing rotation of a peg bar display is shown. The display system includes a horizontally extending rectangular channel having a plurality of oblong holes therein. The holes provide for receiving of a display peg. The display peg has a insertion end having a flattened portion wherein the flattened portion has a width dimension greater than the normal diameter of the peg and greater than a width dimension of the channel hole yet less than a height dimension of the channel hole. Thus, as is known, the pegs can be inserted into the channel holes when the flattened portion is aligned with the height of the channel hole. After insertion therein, the peg is rotated 90 degrees wherein the flattened portion is of a greater dimension than the width of the channel hole, and subsequently can not be withdrawn. When so inserted, the peg divides the interior of the channel into an upper and lower cavity. The present invention utilizes an elongate stop which is inserted into the upper cavity above the level of the pegs. The elongate stop is sized to contact an upper flat portion of each peg and an interior surface of the rectangular channel for preventing any rotation of the pegs.

In a further embodiment a straddle peg is shown. The straddle peg includes a plate attachment end sized to cooperatively fit over the rectangular channel. The attachment plate has a top horizontal surface and a bottom horizontal lip spaced from each other in a vertical direction. The top surface has an upper rod secured on one end centrally thereof and extending outwardly therefrom to a downwardly extending L-shaped end portion thereof. Open ends of a U-shaped rod are secured to the lower lip wherein the U-shaped rod extends therefrom parallel to and below the upper rod, and where the L-shaped end portion of the upper rod is secured centrally of the closed end of the U-shaped rod.

An example of use for the straddle product display of the present invention concerns food products, such as pudding, sold in single serving containers where two or more of the containers are held together and constitute the retailed package. Typically, four of the containers are held together by a partial packaging wrap in two layers of two, one directly on top of the other. In addition, the containers are generally made of a clear plastic and the two lower most containers extend below the packaging wrap so that the contents thereof can be seen. There will also generally exist a cleavage or separation space between the lower containers. The present invention takes advantage of this space wherein the upper rod extends therein between the lower containers, and the bottoms of each container then rest on the lower U-shaped rod. In this manner, the product package "straddles" the upper rod and is supported thereby and is supported by the lower rod. Thus, such a product is firmly supported and held in place, is not subject to unwanted movement thereof and can be easily and quickly loaded thereon-by the retailers and removed therefrom by their customers.

DESCRIPTION OF THE DRAWINGS

A further understanding of the structure function, operation, and advantages of the present invention can be had by referring to the following figures wherein.

DETAILED DESCRIPTION OF THE INVENTION

Figure 1:
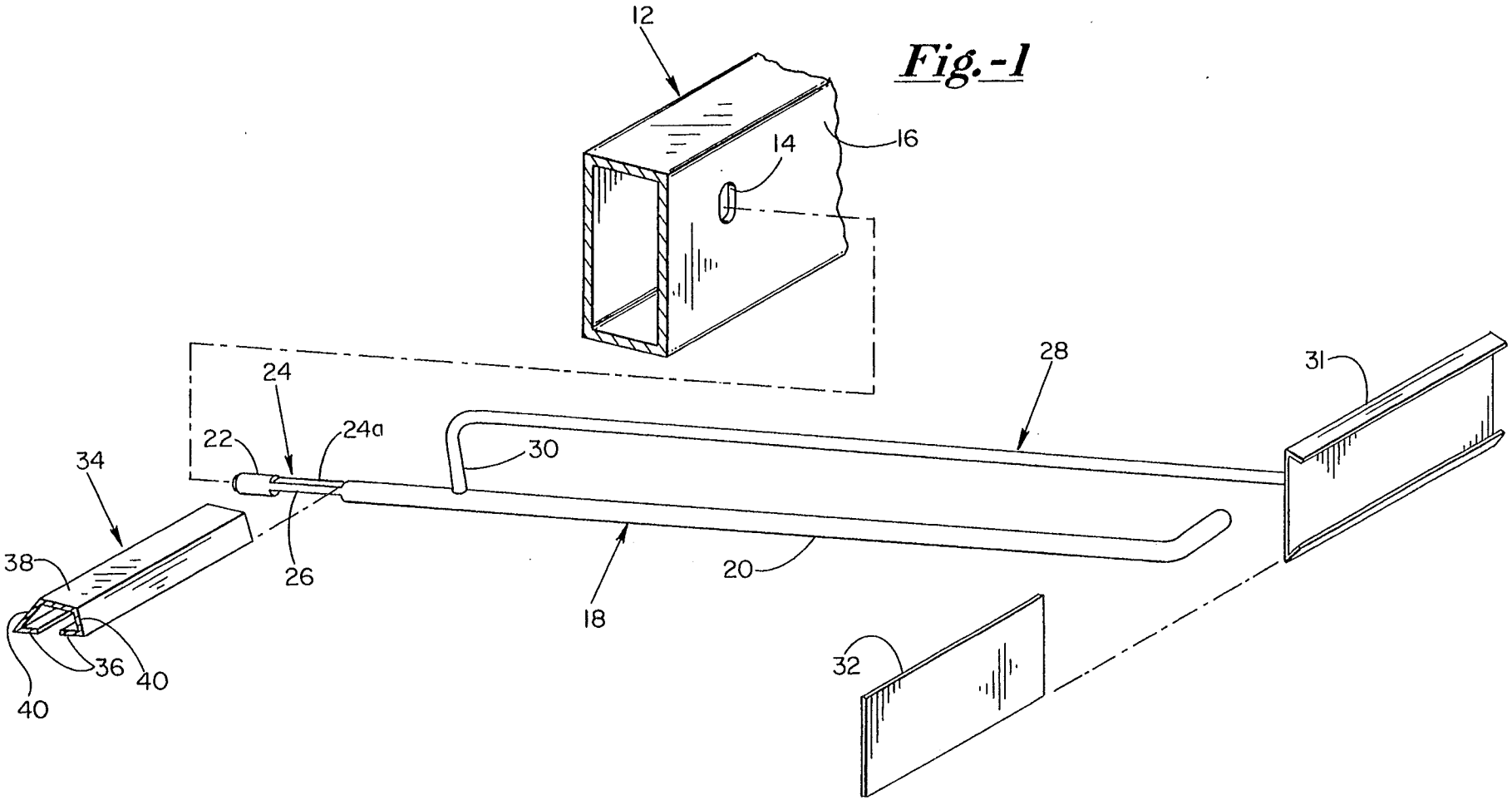
FIG. 1 shows an exploded perspective view of the present invention.
Figure 2:
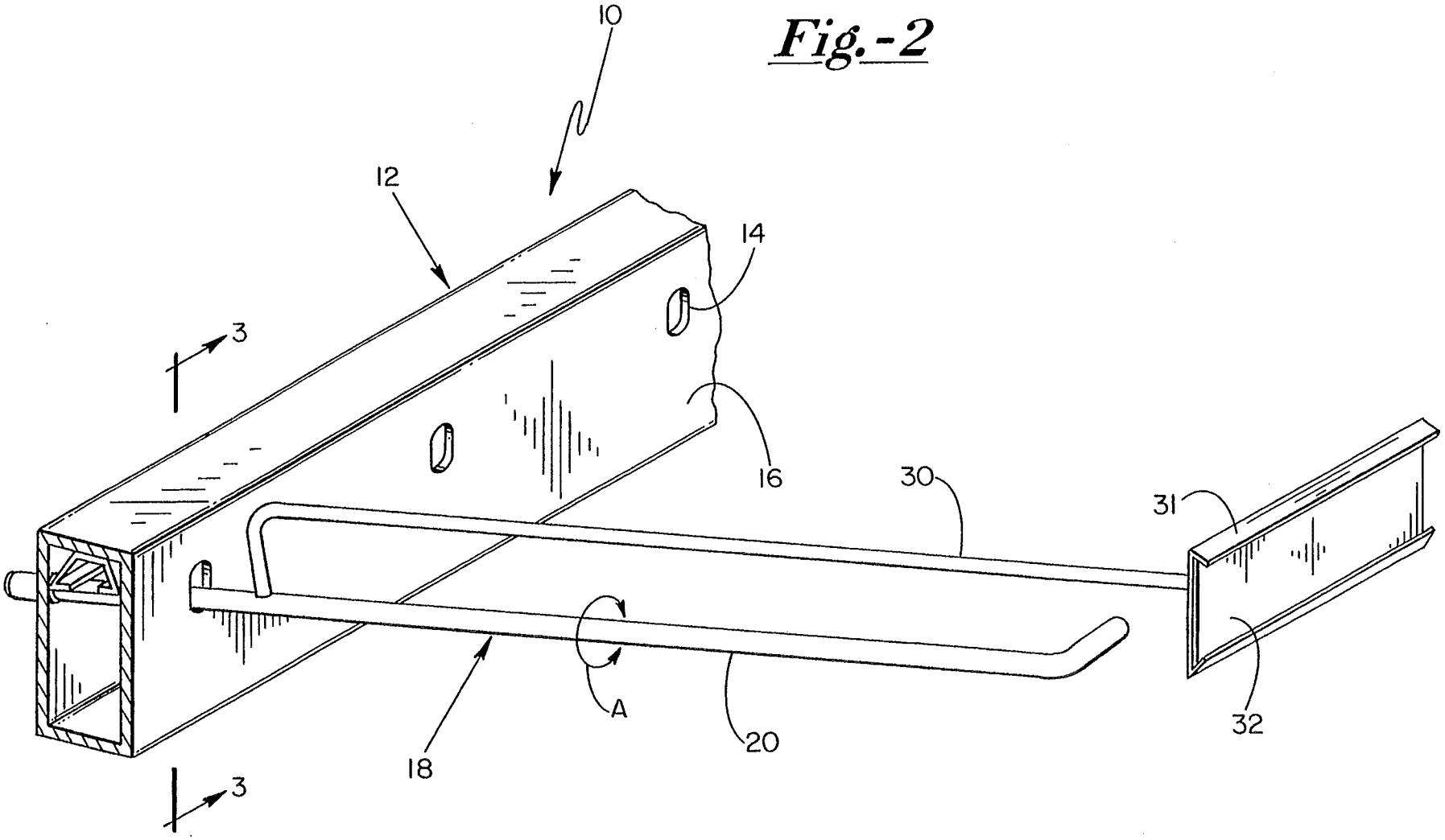
FIG. 2 shows a perspective view of the present invention.
Figure 3:
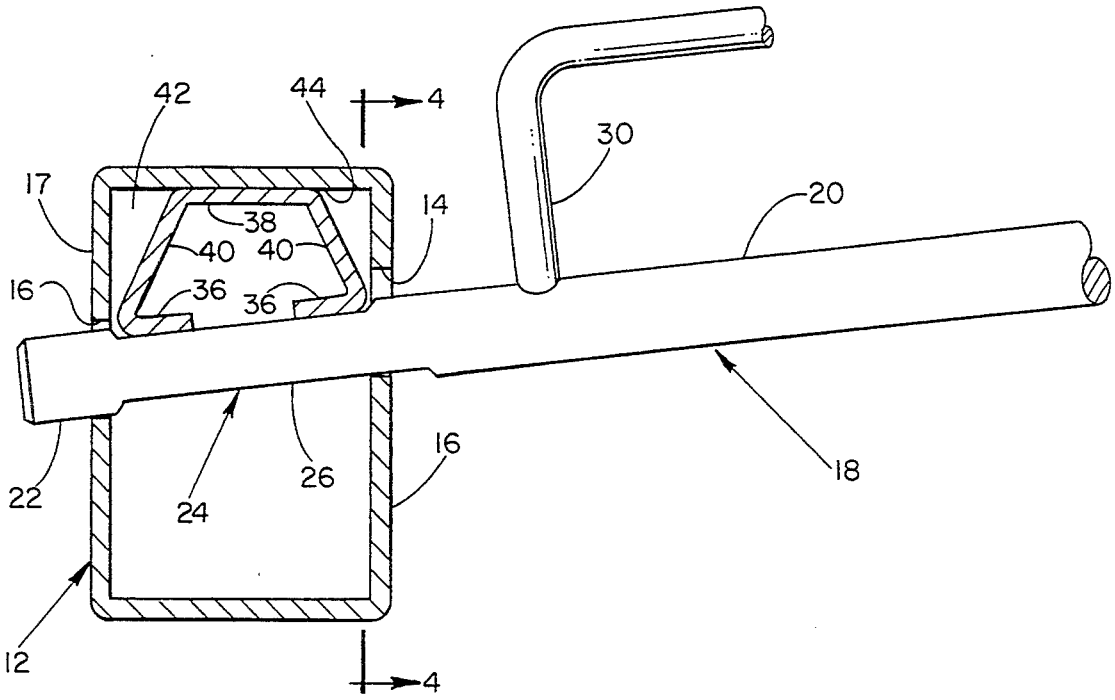
FIG. 3 shows a side plan view along FIG. 3—3 of FIG. 2.
Figure 4:
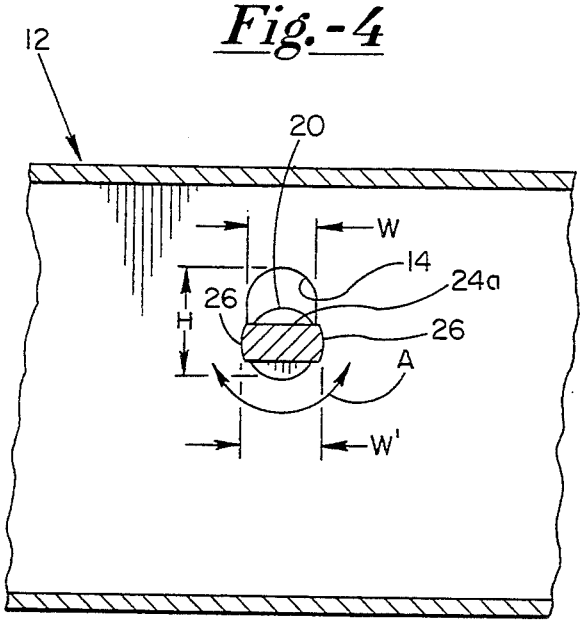
FIG. 4 shows a cross-sectional view along lines 4—4 of FIG. 3.

As seen by referring to FIGS. 1–4, the display device of the present invention is generally indicated by the numeral 10. Display 10 includes an elongate rectangular channel 12 having a plurality of partially oval shaped orifices 14 extending through a front surface 15 thereof and a plurality of corresponding round orifices 16 extending along a back surface 17 thereof. Orifices 14 have a flat bottom edge 14*a* and have a height dimension indicated by the letter H and a width dimension indicated by the letter W. Peg 18 includes an elongate object supporting portion 20 and an insertion end 22. Insertion end 22 includes a flattened portion 24 having a flat top surface 24*a* and a flat bottom surface 24*b*. Flattened portion 24 has a width W' extending between edges 26. A price tag display holder 28 includes an L-shaped leg 30 secured to peg 18 adjacent to end 22 thereof and includes a price display portion 30 for receiving a price tag 32.

An elongate peg rotation stop 34 includes a pair of flanges 36 and a top end 38. Sides 40 extend between and connect legs 36 and top surface 38. It will be appreciated by those of skill that stop 34 can be made of a strip of sheet metal suitably bent to form flanges 36, sides 40 and top 38.

In operation, channel 12, as is known in the art, is supported horizontally by a support means, not shown, and pegs 18 are retained within channel 12. The insertion of a peg 18 requires first orienting flat portion 24 so that edges 26 thereof extend vertically and allow for insertion of end 22 through hole 14, as the width W' thereof is less than the height H. Once inserted wherein end 22 extends outwardly of rear hole 16, peg 18 is rotated 90 degrees so that flattened portion 24 extends horizontally wherein the width W' thereof is greater than the width W of hole 14. Thus, the width W' of flat portion 24 prevents peg 18 from being pulled through hole 14. It will be appreciated by those of skill that the contact between flat surface 24*b* and hole edge 14*a* serve to somewhat prevent rotation of peg 18 around its elongate axis indicated by arrow A in FIG. 4. However, that resistance to rotation is easily overcome especially where peg 18 has a portion extending therefrom such as price display 28. Physical contact with display 28 during loading or removal of product on peg 18 can cause such rotation with the result that display tag 32 will not be positioned it, the desired level or horizontal orientation. Therefore, stop 34 is inserted within an upper space 42 within channel 12 and above pegs 18 to prevent such rotation. Specifically, the bottom flanges 36 thereof closely contact flat surface 24*a* and top end 38 closely contacts an inner top surface 44 of channel 12. It can be appreciated that the insertion of stop 34 thereby prevents any rotation of the pegs 18 around the axis thereof by filling space 42 in a manner that stop 34 can not move whereby peg 18, in turn, can not rotate.

Figure 5:
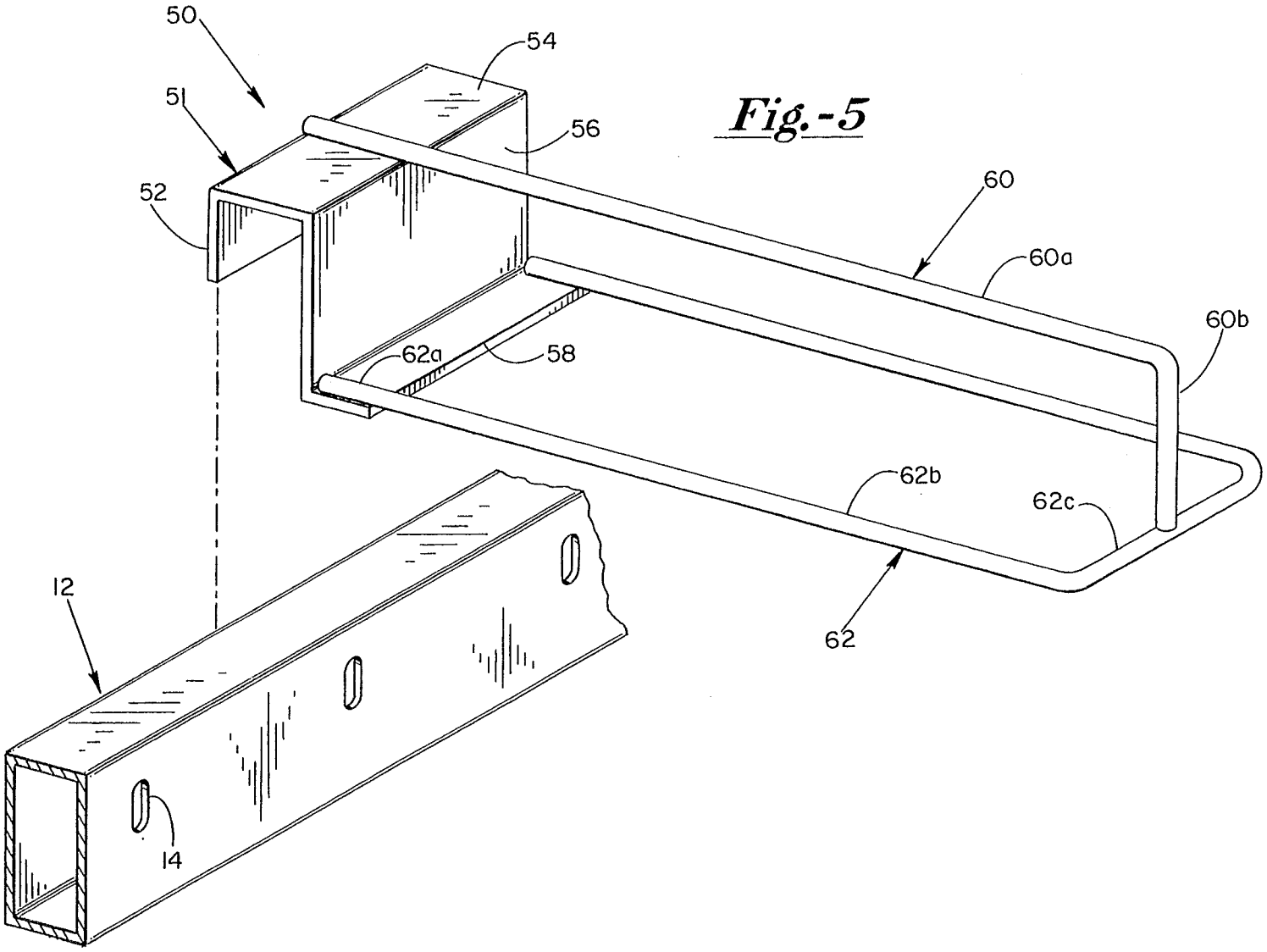
FIG. 5 shows an alternate embodiment of the present invention.
Figure 6:
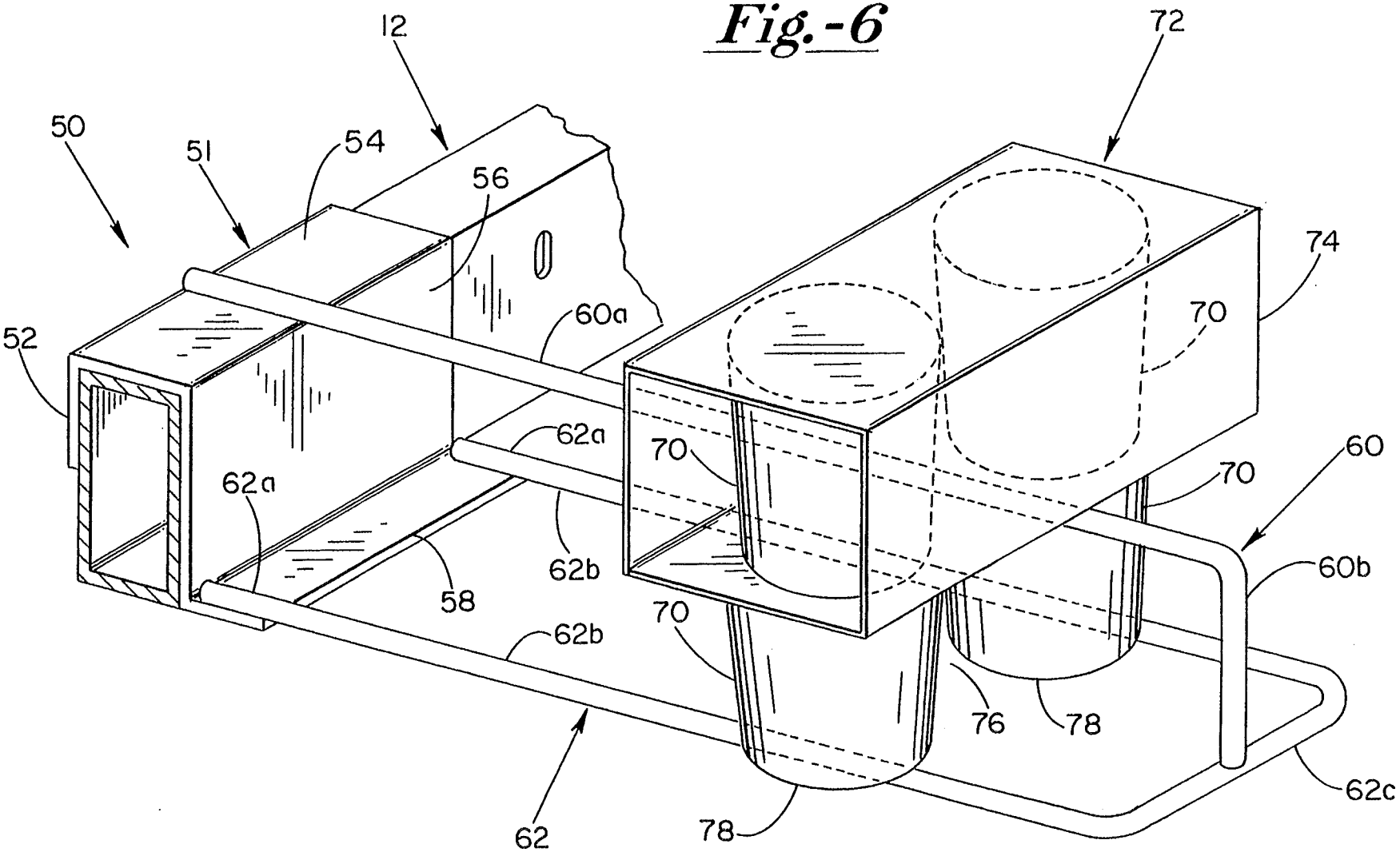
FIG. 6 shows an environmental perspective view of the alternate embodiment of the present invention.

As seen by referring to FIGS. 5 and 6, a display support is shown and generally referred to by the numeral 50. Support 50 includes a retaining end having a rear attachment plate 51. Plate 51 includes a rear vertical portion 52 a top horizontal portion 54, a front vertical portion 56 and a lower horizontal lip portion 58. An upper rod 60 is secured to top surface 54 centrally thereof and extends therefrom. Rod 60 includes an elongate horizontal portion 60*a* and a short vertical portion 60*b*. A U-shaped rod 62 is secured to lower lip 58 on opposite ends thereof by two open ends 62*a* of parallel rods 62*b*, and is secured to vertical portion 60*b* of upper rod 60 centrally of a closed end portion 62*c* thereof.

In operation it can be seen that support 50 is held by placement of plate 50 firing over a rectangular channel, such as channel 12. Of course, holes 14 are not required nor do they perform any function in the use of support 50. An example of use for support 50 involves food products, such as pudding, sold in single serving containers 70 where two or more of the containers 70 are held together and constitute the entire retail package 72. Typically, four of the containers are held together by a partial packaging wrap 74 in two layers of two, one directly on top of the other. In addition, containers 70 are generally made of a clear plastic and the two lower most-containers 70 extend below packaging 74 so that the contents thereof can be seen. There will also generally exist a cleavage or separation space 76 between the lower containers 70. The present invention takes advantage of this space wherein upper rod portion 60*a* extends in space 76 between lower containers 70, wherein bottoms 78 of each container then rest on respective lower parallel rod portions 62*b*. In this manner, product package 72 "straddles" upper rod 60 and is supported thereby, and is supported by lower parallel rod portions 62*b*. Thus, such a product 72 is firmly supported and held in place, is not subject to unwanted movement thereof and can be easily and quickly loaded on support 50 by the retailers and removed therefrom by their customers. In addition, it can be understood that support 50 can be easily moved along channel 12 to any position there along so as to easily and quickly adapt to the support of a wide variety of differently shaped products. Moreover, the support means, such as horizontally supported channels 12, can be spaced apart one above the other so as to most efficiently use the vertical space allotted to product 72.

I claim:

1. A support device for supporting and displaying one or more objects therefrom, the objects having a bilateral symmetry having a first half and a second half wherein the first and second halves are separated by a cleavage space, and each first and second half having bottom surfaces, the supporting device comprising:

an attachment end for providing releasable securing to a support means, first and second rods secured on first ends thereof to a bottom portion of the attachment end and extending therefrom substantially parallel with each other to second ends thereof respectively, a third rod secured on a first end thereof to a top portion of the attachment means and extending therefrom substantially parallel to the first and second rods to a second end thereof and the third rod held above and extending substantially centrally of the first and second rods so that the one or more objects can be placed on the support device wherein the third rod extends in the cleavage space thereof and where the first and second half bottom surfaces of the one or more objects rest adjacent the first and second rods respectively.

2. The device as defined in claim 1, and the first, second and third rods joined together at their respective second ends.

3. The device as defined in claim 1, and the attachment end being a bracket shaped for releasable securing to a channel rod.

4. A support device for supporting and displaying a plurality of objects therefrom, the objects having a bilateral symmetry having a first half and a second half wherein the first and second halves are equivalent and separated by a cleavage space, and each object half having a bottom surface, the support device comprising:

an attachment end for providing releasable securing to a substantially horizontally oriented channel bar, the attachment end comprising a bracket having a first vertical portion, a horizontal lip extending from and along a bottom edge of the vertical portion, a top surface portion extending from and along a top edge of the vertical portion in a direction opposite from the extension of the bottom lip and a second vertical portion extending from and along a rear edge of the top surface portion, and the top surface portion and the first and second vertical portions forming a channel bar receiving space, first and second rods having first and second ends respectively and the first ends thereof secured to the bottom lip portion on opposite sides thereof and extending therefrom substantially parallel with each other, a third rod having a first and second end and the first end thereof secured to the top surface portion and extending therefrom substantially parallel to the first and second rods and substantially centrally thereto so that the objects can be placed on the support device wherein the third rod extends in the cleavage spaces thereof and where the first and second rods extend below and adjacent the bottom surfaces of the objects first and second halves respectively.

5. The device as defined in claim 4, and the first, second and third rods secured together at their second ends.

6. The device as defined in claim 4, and the first and second rods comprising a U-shaped rod having two free ends opposite from a closed end and the free ends thereof secured to opposite sides of the bottom lip.

7. The device as defined in claim 6, and the third rod being L-shaped having an elongate portion and a short portion extending transverse thereto, the elongate portion having a free end and the short portion having a free end, and the long portion free end secured to the top surface portion wherein the short portion is oriented in a downward direction towards the U-shaped rod, and the short portion free end secured to the U-shaped rod closed end.

* * * * *